US007331197B2

(12) United States Patent
Burach

(10) Patent No.: US 7,331,197 B2
(45) Date of Patent: Feb. 19, 2008

(54) DECORATIVE EARRING SLEEVE

(76) Inventor: Elizabeth Burach, 2315 Pine Oak La., Arlington, TX (US) 76012

( * ) Notice: Subject to any disclaimer, the term of this patent is extended or adjusted under 35 U.S.C. 154(b) by 212 days.

(21) Appl. No.: 11/306,377

(22) Filed: Dec. 26, 2005

(65) Prior Publication Data

US 2007/0137251 A1 Jun. 21, 2007

Related U.S. Application Data

(60) Provisional application No. 60/641,668, filed on Jan. 6, 2005.

(51) Int. Cl.
*A44C 25/00* (2006.01)

(52) U.S. Cl. ..... 63/35; 63/29.1; 63/31; 63/40; 63/9

(58) Field of Classification Search ..... None
See application file for complete search history.

(56) References Cited

U.S. PATENT DOCUMENTS

| | | | | | |
|---|---|---|---|---|---|
| 242,528 | A | | 6/1881 | Granbery | |
| 331,033 | A | * | 11/1885 | Chadwick | 63/11 |
| 397,833 | A | * | 2/1889 | Colby | 63/11 |
| 427,593 | A | * | 5/1890 | Mathewson | 63/11 |
| 483,214 | A | | 9/1892 | Gaynor | |
| 711,269 | A | | 10/1902 | Wolfberg | |
| 921,759 | A | * | 5/1909 | Walker | 63/28 |
| 1,099,810 | A | * | 6/1914 | Mehrlust | 59/79.3 |
| 1,192,092 | A | * | 7/1916 | Morse | 63/28 |
| 1,442,815 | A | * | 1/1923 | Maker et al. | 63/20 |
| 1,469,450 | A | * | 10/1923 | Stone | 132/148 |
| 1,536,189 | A | * | 5/1925 | Codman | 63/29.1 |
| 1,589,423 | A | * | 6/1926 | Payton | 63/4 |
| 3,733,851 | A | * | 5/1973 | D'Apuzzo | 63/43 |
| 4,237,702 | A | * | 12/1980 | Caverly | 63/3.2 |
| 4,781,038 | A | * | 11/1988 | Branca et al. | 63/26 |
| 4,803,852 | A | | 2/1989 | Waldron | |
| 4,912,944 | A | * | 4/1990 | Crosley et al. | 63/29.2 |
| 5,836,176 | A | | 11/1998 | Lichtenstein | |
| 6,058,737 | A | | 5/2000 | Domagala | |
| 6,289,903 | B1 | * | 9/2001 | Haufler | 132/275 |
| 6,412,303 | B1 | * | 7/2002 | Lee | 63/3 |
| 6,508,081 | B1 | | 1/2003 | Simpson | |
| 6,925,838 | B1 | | 8/2005 | Carmack | |

* cited by examiner

*Primary Examiner*—Jack W. Lavinder
(74) *Attorney, Agent, or Firm*—QuickPatents, Inc.; Kevin Prince

(57) ABSTRACT

A decorative earring sleeve is disclosed, the decorative earring sleeve for slidable engagement with an earring of the type having an elongated, curved loop for insertion into a person's pierced ear. The decorative earring sleeve includes a plurality of decorative settings, each of which includes a front viewing surface and an opposing back surface. Each back surface includes an annular ringlet for receiving the curved loop of the earring. A plurality of flexible connectors are further included, the connectors being attached between each decorative setting. Preferably each connector further includes an elastic portion, such that the decorative settings are each urged toward each other linearly. In use, the ringlet of each decorative setting may be slid over the loop of the earring, in turn, such that each viewing surface is oriented away from the person's ear to enhance the appearance of the earring.

13 Claims, 2 Drawing Sheets

DECORATIVE EARRING SLEEVE

CROSS-REFERENCE TO RELATED APPLICATIONS

This application claims the benefit of U.S. Provisional Patent Application 60/641,668, filed on Jan. 6, 2005, which is hereby incorporated in its entirety by reference.

STATEMENT REGARDING FEDERALLY SPONSORED RESEARCH AND DEVELOPMENT

Not Applicable.

1. Field of the Invention

This invention relates to jewelry, and more particularly to a decorative earring sleeve.

2. Discussion of Related Art

So called "lever back" or "French wire" earrings have gained in popularity, due in part to their lack of needing a post to secure such an earring to a person's pierced ear. Such lever back earrings, however, have the drawback that the looped post in front of the ear is almost always visible, and is typically nothing more than a gold wire, or the like. Such a bare wire lacks adornment, and may, in fact, clash with the rest of the earring, particularly with earrings that have interchangeable types of decorations or gemstones.

For example, U.S. Pat. No. 5,836,176, issued to Lichtenstein on Nov. 17, 1998, teaches a French wire earring having a removable ornament. Such a device, however, makes no provision for covering the wire of the earring with an ornament or a series of ornaments that enhance the appearance of the earring ornament.

U.S. Pat. No. 6,058,737 to Domagala on May 9, 2000, teaches an earring assembly that enables an additional gemstone or component to be selectively attached or removed. However, such a device nor the attachable gemstones or attachable components are suitable for affixing to an existing lever back-type earring.

Therefore, there is a need for an inexpensive auxiliary means for adorning existing lever back-type earrings. Such a needed invention would provide for a wide variety of additional styles and types of attachable adornments. Further, such a needed invention would be easy to use and allow for quickly changing the appearance of existing lever back-type earrings. The present invention accomplishes these objectives.

SUMMARY OF THE INVENTION

The present device is a decorative earring sleeve for slidable engagement with an earring of the type having an elongated, curved loop for insertion into a person's pierced ear. The decorative earring sleeve includes a plurality of decorative settings, each of which includes a front viewing surface and an opposing back surface. Each back surface includes an annular ringlet for receiving the curved loop of the earring.

A plurality of flexible connectors are further included, the connectors being attached between each decorative setting. Preferably each connector further includes an elastic portion, such that the decorative settings are each urged toward each other linearly. Further, each connector preferably terminates in an enlarged section that is prevented from being pulled out of an aperture of each decorative setting.

In use, the ringlet of each decorative setting may be slid over the loop of the earring, in turn, such that each viewing surface is oriented away from the person's ear to enhance the appearance of the earring.

The present invention is an inexpensive auxiliary means for adorning existing lever back-type earrings. The present invention provides for a wide variety of additional styles and types of attachable adornments, and is also easy to use and allows for quickly changing the appearance of existing lever back-type earrings. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
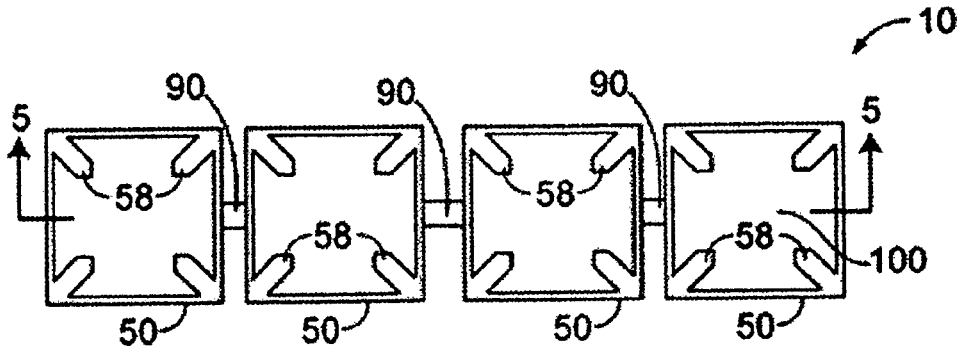
FIG. 1 is a front elevational view of the invention, illustrating a plurality of decorative settings each having a viewing surface and interconnected with a flexible connector.
Figure 4:
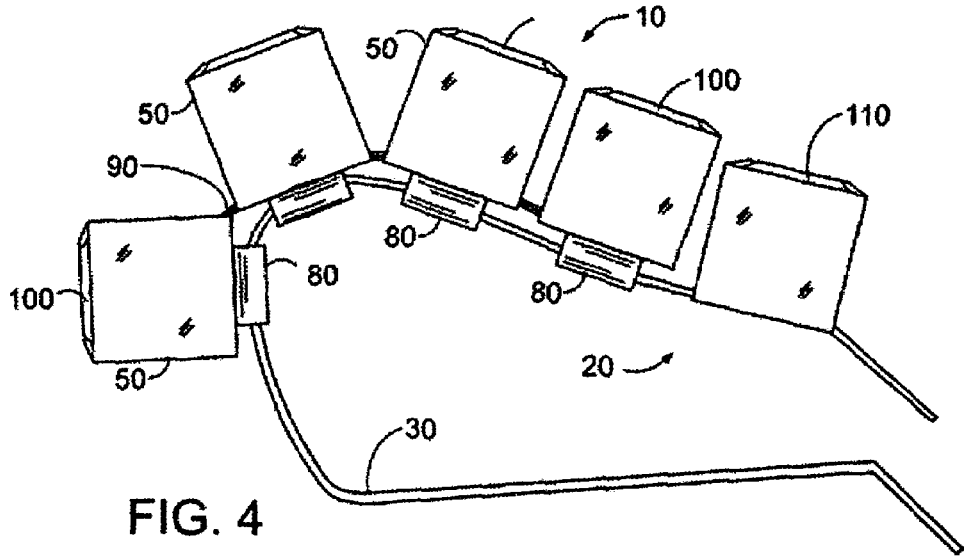
FIG. 4 is a right-side elevational view of the invention, illustrating a sleeve of the invention as attached to a curved loop of an earring.

FIGS. 1 and 4 illustrate a decorative earring sleeve 10 for slidable engagement with an earring 20 of the type having an elongated, curved loop 30 for insertion into a person's pierced ear (not shown). Such looped earrings 20 are commonly referred to as "French wire," "lever back," or "looped post" type earrings 20.

Figure 3:
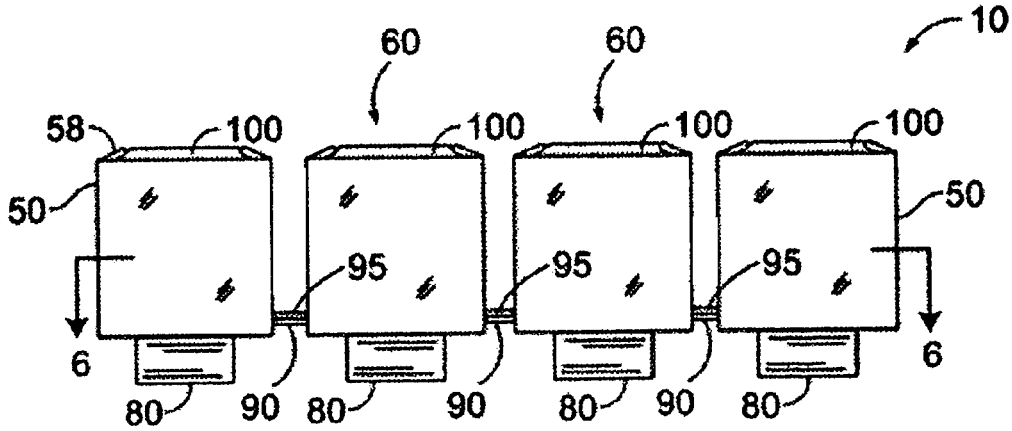
FIG. 3 is a right-side elevational view of the invention, the left-side elevational view being a mirror image thereof.

The decorative earring sleeve 10 includes a plurality of decorative settings 50, each of which includes a front viewing surface 60 and an opposing back surface 70. Each back surface 70 includes an annular ringlet 80 for receiving the curved loop 30 of the earring 20 (FIGS. 3 and 4). Preferably each decorative setting is made from a rare metal such as gold, silver, or platinum. Additionally, each decorative setting 50 may further include a gemstone setting 58 and a gemstone 100.

Each decorative setting 50 is preferably identical, but may also have a unique appearance amongst the other decorative settings 50. For example, each decorative setting 50 may be comprised of gold metal, but have varying colors or styles of gemstones 100. In the case where the earring 20 includes a gemstone 110 (FIG. 4), then each gemstone 100 of each decorative setting 50 may be chosen from the same type or style thereof.

Figure 2:
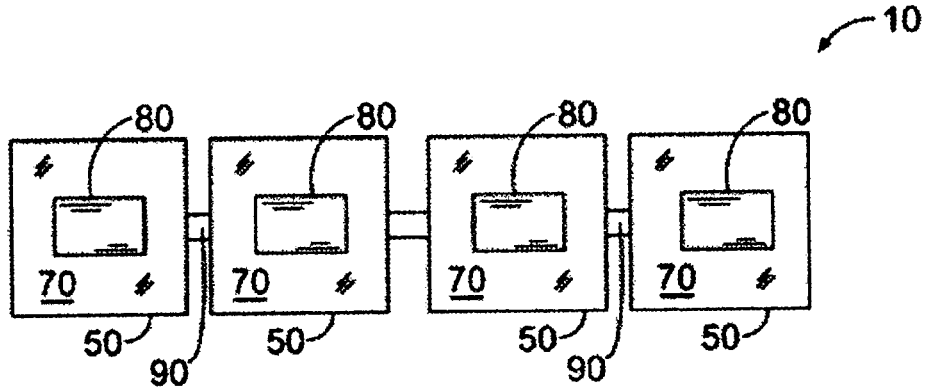
FIG. 2 is a rear elevational view of the invention, illustrating the plurality of decorative settings each having a back surface with a ringlet attached thereto.

Preferably, and as best shown in FIGS. 2 and 3, the viewable surface 60 of each decorative setting 50 is generally square in shape. Alternately, however, each viewable surface 60 may take a circular, rectangular, triangular, oval, or other shape as suitable for the user. Thus, while the drawings illustrate each viewable surface 60 as being generally square, it is to be understood that such is not meant to limit the scope of the present invention.

Figure 5:
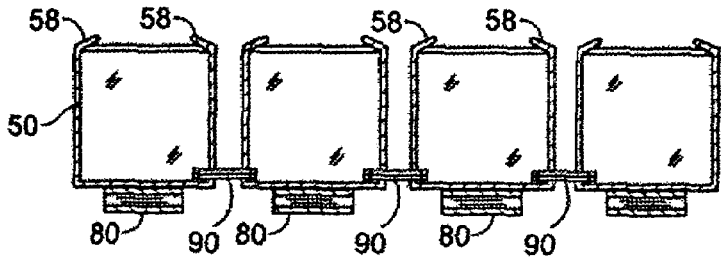
FIG. 5 is a cross-sectional view of the invention, taken generally along lines 5-5 of FIG. 1.
Figure 7:
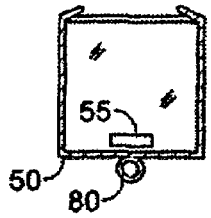
FIG. 7 is a cross-sectional view of the invention, taken generally along lines 7-7 of FIG. 6.
Figure 6:
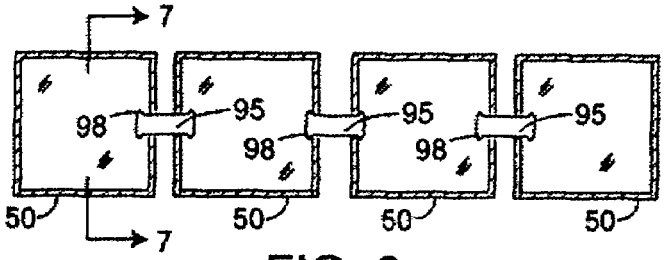
FIG. 6 is a cross-sectional view of the invention, taken generally along lines 6-6 of FIG. 3.

A plurality of flexible connectors 90 are further included, the connectors 90 being attached between each decorative setting 50. Preferably each connector 90 further includes an elastic portion 95, such that the decorative settings 50 are each urged toward each other linearly (FIGS. 5 and 6). FIG. 6 illustrates a cross-sectional view, showing how each connector 90 is connected to each decorative setting 50. Preferably each connector 90 terminates in an enlarged section 98 that is prevented from being pulled out of an aperture 55 of each decorative setting 50 (FIGS. 6 and 7).

In use, the ringlet 80 of each decorative setting 50 may be slid over the loop 30 of the earring 20, in turn, such that each viewing surface 60 is oriented away from the person's ear to enhance the appearance of the earring 20.

Preferably, the sleeve 10 of the present invention includes four decorative settings 50, as shown in the illustrations. However, alternate embodiments of the invention could easily be made wherein the number of decorative settings 50 is three, two, or even one. Some French wire earrings have less exposed wire in front of the person's ear than common lever back earrings, and as such most French wire-type earrings may only allow a sleeve 10 having two or three decorative settings 50. In the case where the sleeve includes just one decorative setting 50, clearly there is no need for the flexible connectors 90 between decorative settings 50. While the illustrations show the preferred embodiment, it is to be understood that such is not meant to be limiting as to the number or shape or style of the decorative settings 50.

While a particular form of the invention has been illustrated and described, it will be apparent that various modifications can be made without departing from the spirit and scope of the invention. For example, the exact style, material, or shape of decorative settings 50 or gemstones 100 may be modified in any number of ways. Accordingly, it is not intended that the invention be limited, except as by the appended claims.

What is claimed is:

1. A decorative earring sleeve for slidable engagement with an earring of the type having an elongated, curved loop for insertion into a person's pierced ear, the decorative earring sleeve comprising:

a plurality of decorative settings, each decorative setting including a viewing surface and an opposing back surface, the back surface including a ringlet for receiving the curved loop of the earring;

a plurality of flexible connectors, the connectors attached between each decorative setting;

whereby the ringlet of each decorative setting may be slid over the loop of the earring, in turn, such that each viewing surface of each decorative setting is oriented away from the person's ear to enhance the appearance of the earring.

2. The decorative earring sleeve of claim 1 wherein the flexible connector further includes an elastic portion, whereby the decorative settings are each urged together linearly.

3. The decorative earring sleeve of claim 1 wherein each decorative setting is comprised of a rare metal.

4. The decorative earring sleeve of claim 1 wherein each decorative setting includes a gemstone.

5. The decorative earring sleeve of claim 4 wherein each gemstone of each decorative setting is substantially identical in appearance.

6. The decorative earring sleeve of claim 4 wherein each gemstone of each decorative setting is unique amongst each other gemstone.

7. The decorative earring sleeve of claim 4 wherein each gemstone of each decorative setting is substantially identical in appearance to a gemstone of the earring.

8. The decorative earring sleeve of claim 1 wherein each viewable surface is substantially square.

9. The decorative earring sleeve of claim 1 wherein each viewable surface is substantially circular.

10. The decorative earring sleeve of claim 1 wherein the plurality of decorative settings is exactly four.

11. The decorative earring sleeve of claim 1 wherein the plurality of decorative settings is exactly three.

12. The decorative earring sleeve of claim 1 wherein the plurality of decorative settings is exactly two.

13. The decorative earring sleeve of claim 1 wherein the plurality of decorative settings is exactly one.

* * * * *